United States Patent [19]

Daugherty et al.

[11] 4,172,243

[45] Oct. 23, 1979

[54] TRANSFORMER WITH A LIQUID COOLED CASE AND A METHOD FOR MAKING THE LIQUID COOLED CASE

[75] Inventors: Roger H. Daugherty, Wilkinsburg; Roger L. Swensrud, Plum Borough; Michael R. Jugan, Duquesne, all of Pa.

[73] Assignee: Westinghouse Electric Corp., Pittsburgh, Pa.

[21] Appl. No.: 805,367

[22] Filed: Jun. 10, 1977

[51] Int. Cl.[2] ..... H01F 27/10

[52] U.S. Cl. ..... 336/60; 29/527.5; 174/15 R

[58] Field of Search ..... 336/55, 57, 58, 60, 336/61, 90; 174/15 R, 16 R; 310/60 A, 54

[56] References Cited

U.S. PATENT DOCUMENTS

| | | | |
|---|---|---|---|
| 726,936 | 5/1903 | Johnston | 174/15 R |
| 1,310,097 | 1/1919 | Treanor | 336/58 |
| 1,374,662 | 4/1921 | Johannesen | 336/58 X |
| 1,830,457 | 11/1931 | Apple | 310/54 |
| 2,462,451 | 2/1949 | Winther | 310/54 |
| 2,685,677 | 8/1954 | Paluev | 336/57 |
| 2,862,119 | 11/1958 | Else et al. | 310/54 |
| 2,862,120 | 11/1958 | Onsrud | 310/54 |
| 3,056,071 | 9/1962 | Baker et al. | 336/60 X |
| 3,201,728 | 8/1965 | McWhirter | 336/60 |
| 3,371,299 | 2/1968 | Radkowski et al. | 336/57 |
| 3,437,965 | 4/1969 | Ragsdale | 336/61 |
| 3,609,991 | 10/1971 | Chu et al. | 174/15 R X |
| 3,713,060 | 1/1973 | Harlow | 336/58 |
| 3,793,603 | 2/1974 | Fontaine | 174/15 R X |

FOREIGN PATENT DOCUMENTS

| | | | |
|---|---|---|---|
| 2056366 | 5/1972 | Fed. Rep. of Germany | 336/60 |
| 1613759 | 8/1973 | Fed. Rep. of Germany | 336/61 |

*Primary Examiner*—Thomas J. Kozma
*Attorney, Agent, or Firm*—G. H. Telfer

[57] ABSTRACT

Disclosed is an electrical transformer having a core and coil assembly mounted in a hollow case and a method of manufacturing the case. The hollow case has cast at least one cooling duct within it. Each cooling duct is a hollow tube, formed into a loop, with its ends brazed into a manifold. The manifold has nipples brazed into it which provide a connecting passage for the flow of coolant through the nipples into the manifold and through the tubes that have been cast within the transformer case.

2 Claims, 8 Drawing Figures

TRANSFORMER WITH A LIQUID COOLED CASE AND A METHOD FOR MAKING THE LIQUID COOLED CASE

BACKGROUND OF THE INVENTION

1. Field of the Invention

This invention relates to transformers mounted within a case having cooling ducts embedded therein.

2. Description of the Prior Art

The cooling of large transformers has always been a troublesome area for the designer. In the prior art several methods have been used with some success. One method being submerging the transformer core windings in a container containing insulating and cooling oil. However, as the units become larger it was necessary to cool the insulating oil. This was disclosed in U.S. Pat. No. 1,310,097, issued July 15, 1919.

Other methods have been used to cool large transformers such as that disclosed in U.S. Pat. No. 3,371,299 in which there were ducts between the windings which ran to the outside of the transformer. Coolant was circulated through the duct network removing the heat from the transformer and carrying it to the outside atmosphere where the coolant would dissipate the heat. Another method included compartmentalizing the transformer, flowing coolant through the different compartments, and circulating it through a heat exchanger in order to keep the transformer operating within desirable limits. This was disclosed in U.S. Pat. No. 2,685,677 issued Aug. 3, 1954. Also, there have been other methods where windings of the transformer were made with hollow tubing and coolant was forced through the hollow tubing to remove the excess heat. An improvement on using the winding as a coolant conductor was disclosed in U.S. Pat. No. 3,056,071 issued Sept. 25, 1962 wherein the conductor which was used to wind the coil had a plurality of indentations. When the unit was wound the indentations would align forming passages through which coolant could be forced thereby facilitating the removal of excess heat.

One particular troublesome area is current transformers. Current transformers have no primary of their own but are installed around a cable, a conductor, or a bushing which provides its own insulation from the core and secondary winding. They are used, in one particular application, as part of the instrumentation package of a generator facility. Until the recent development of large turbine generators with current ratings over 34,000 amps, it had been acceptable to design current transformer cases that are cooled by natural air convection. Large transformers were cooled by adding fins to the outer diameter of the case to provide as much area as possible exposed to natural air convection. The primary heat generated in the transformer case is a result of induced circulating currents in the case due to the flux created by the line current.

While most current transformer cases have been constructed of aluminum, for large ratings it has been necessary to build some of copper to reduce the generated heat loss, if the case is air cooled. However, for the newer machines which sometimes have ratings over 34,000 amps, none of the prior art air-cooled cases are desirable.

SUMMARY OF THE INVENTION

Disclosed is an electrical transformer mounted in a hollow case. The hollow case has at least one cooling duct embedded within it. The transformer is insulated from the case by being surrounded by a non-volatile cooling and insulating medium. There is provided a means for connecting the cooling ducts to an inlet conduit and an outlet conduit on the outside of the case, thereby facilitating circulation of coolant through the cooling ducts embedded in the transformer case.

The cooling ducts can be a single loop embedded within the case or a plurality of loops connected to a common input and output manifold. It is also possible to have a coil shaped cooling duct embedded within the case with one end being connected to an input manifold and the other end being connected to an output manifold.

Also disclosed is the method of manufacturing this transformer case wherein a metal tubing such as stainless steel is bent into a loop and connected to an input and output manifold also made of a metal such as stainless steel. This cooling duct combination is inserted in a sand casting of the transformer case. Molten metal, such as aluminum, is then poured into the sand casting and allowed to cool. Thus, the case is formed by casting metal tubing within a metal case.

This liquid cooled transformer case has been designed to eliminate the need for such heat transfer means as fins or blower assemblies which are mounted around the transformer case. The implementation of this invention can result in reduced weight and also eliminate the need to build future current transformer cases out of copper.

BRIEF DESCRIPTION OF THE DRAWINGS

For a better understanding of the invention, reference may be had to the preferred embodiment, exemplary of the invention, shown in the accompanying drawings in which.

DESCRIPTION OF THE PREFERRED EMBODIMENT

Parts of the instrumentation necessary for efficient operation of a generator facility are current transformers. The transformers are used to detect out of balance conditions between the windings, and as a means of regulating the generator.

It has been found that, when the current rating exceeds 34,000 amps, the state of the art design current transformer is no longer adequate. As was stated earlier, the transformer cases are normally cooled by natural air convection. To assist this process fins are added around the outer periphery of the case to provide as much area as possible exposed to the air. The primary heat generated in the case is a result of induced current circulating in the case. The current is due to the flux created by the generator's line current. The case is necessary to prevent the flux from affecting the current transformer accuracy. To solve this problem a liquid cooled transformer case 1 as shown in FIG. 1 has been designed to meet the needs of the larger generator.

Figure 2:
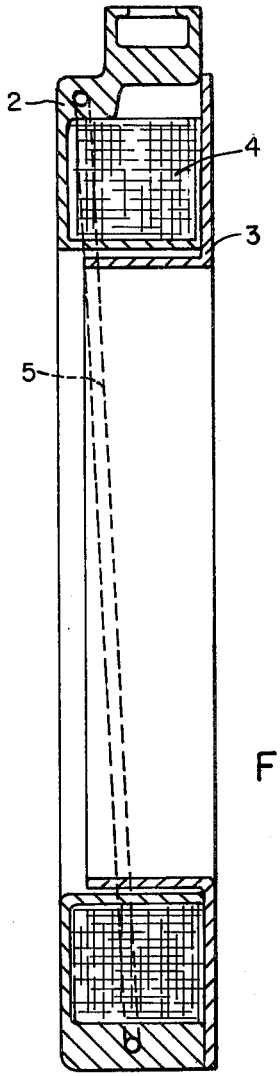
FIG. 2 is a side view of a current transformer as viewed from section line II—II of FIG. 1.
Figure 1:
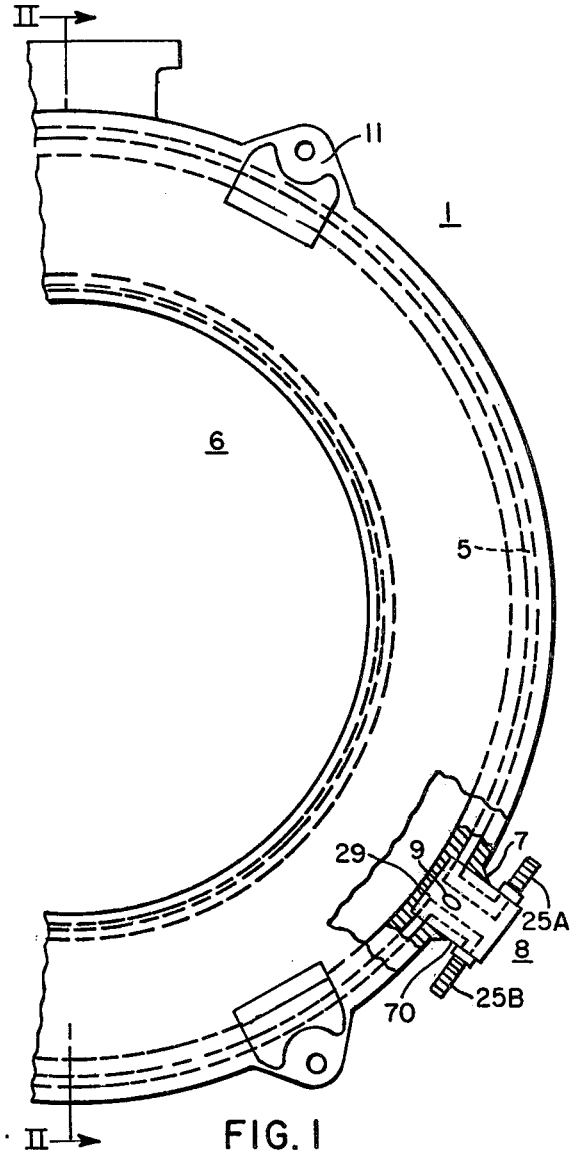
FIG. 1 is a partially sectioned view of a current transformer with a single loop cooling duct embedded therein.

Referring to FIGS. 1 and 2, there is a current transformer 1 which has a base unit 2, and mounting brackets 11. Mounted within the case is a current transformer's winding and core assembly 4. The current transformer's winding and core assembly is insulated from the case by use of an insulating medium such as an epoxy resin. The transformer case is shaped like a toroid with an opening 6 in its center. Because the unit is a current transformer, a current bus from the generator is placed through opening 6 and acts as the primary winding of the transformer.

Embedded within the transformer base unit 2 is a cooling duct assembly 8. The cooling duct assembly is made up of an embedded loop-shaped tubing 5 and a manifold 7.

In constructing the transformer case the one parameter that must be considered is the melting temperature of the cooling duct assembly 8, which must be substantially higher than the melting temperature of the material used to make the case. Another parameter to consider is that the materials used must have approximately the same expansion coefficient. Although there are several different types of materials that can be used in the manufacturing of the cooling duct assembly 8 and the case 1, it has been found that casting a stainless steel cooling duct assembly in an aluminum case was preferable.

The method of manufacturing of the unit consists of constructing a manifold by brazing stainless steel nipples 25 into a block of stainless steel 70 through which holes 29 have been drilled to provide connecting paths for the passage of the coolant. A stainless steel hollow tube 5 is formed into a loop and its ends braced into the manifold 7 forming the cooling duct assembly 8. The cooling duct assembly is positioned in a sand mold of the transformer case and then molten aluminum is added to cast the transformer case. For holding the manifold in place there is an alignment hole 9 which runs the length of the stainless steel block. During the casting of the transformer case, the hole 9 will be filled with the case material forming a retaining shaft. After the casting has cooled, the case is removed for cleaning and preparation for assembly into a transformer.

Figure 3:
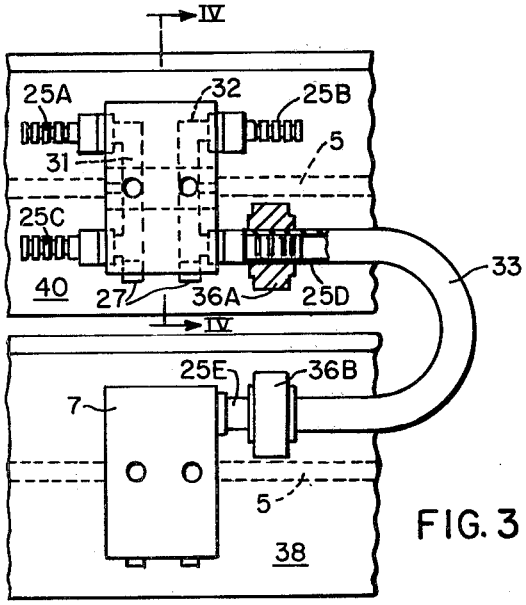
FIG. 3 shows the connecting together of more than one transformer cases' cooling ducts.

Because in most generator facilities there is a need for several current transformers, FIG. 3 shows a method by which the cooling ducts of these transformers can be connected together in parallel. (For series connection the manifold assembly of FIG. 1 may be used). There are four nipples brazed into the manifold, these being 25*a, b, c* and *d*. There is an input conduit 32 drilled into the manifold connecting the cooling duct 5 to nipples 25*b* and 25*d*. Nipple 25*d* is connected to the input nipple 25*e* of the second transformer 38 by a conduit 33 which can be made of a material such as Teflon or copper. Couplings 36*a* and 36*b* retain the conduit 33 on the nipple 25*d*, 25*e*. A similar connecting scheme can be accomplished on the return side of the first transformer case 40. There is a conduit means 31 which is the return conduit and it joins nipples 25*a* and 25*c* to the cooling duct tubing 5.

Figure 4:
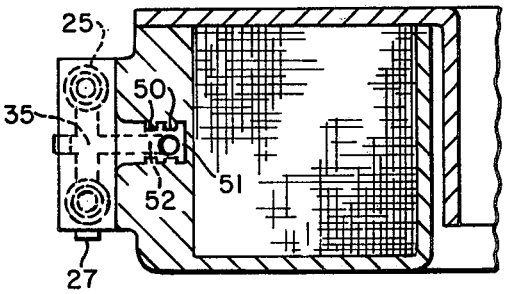
FIG. 4 shows the manifold area of a transformer case as viewed by section lines IV—IV.

FIG. 4 is a side view of the manifold assembly as seen from section line IV—IV. Although hole 9 provides support and retention of the manifold assembly 7, the manifold assembly may be lightened by machining a nipple ledge 51 on that portion of the manifold which is to be embedded in the transformer case. The nipple end has a plurality of lands 50 and furrows 52 which assist the alignment hole 9 in retaining the manifold in place during casting and provides extra strength to the completed case.

Figure 5:
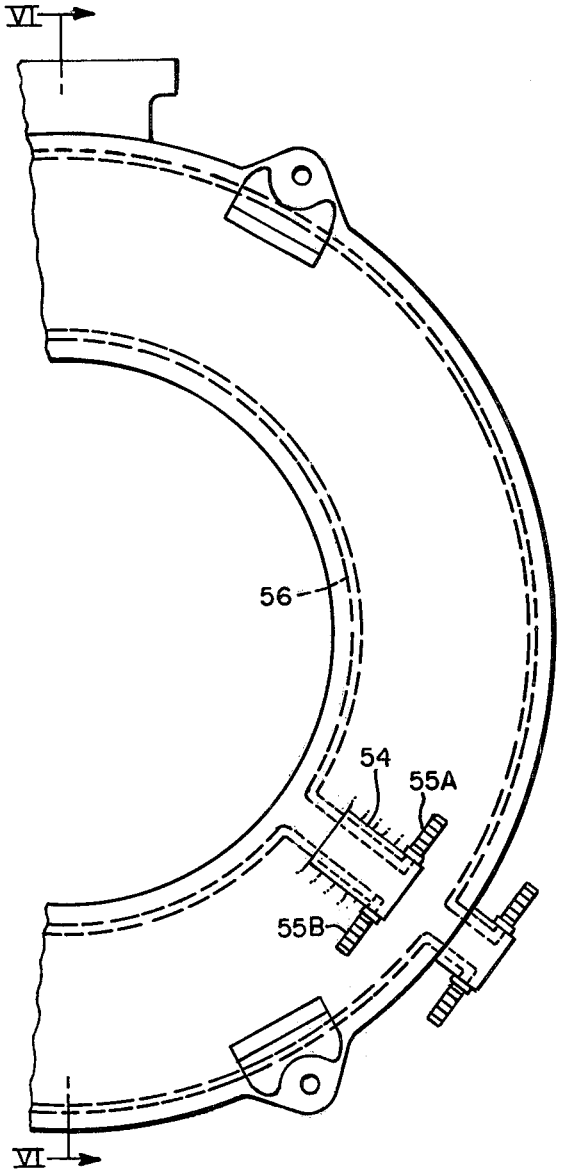
FIG. 5 is a partially sectioned view of a current transformer showing another embodiment of this invention.

FIG. 5 is a top view of a current transformer which has a cooling duct embedded in its top cover as well as the base unit. There is a manifold 54 which has nipples 55*a* and 55*b* and a looped duct 56 which is embedded into the cover and brazed to the manifold 54. This type of cover for the transformer case is manufactured by the same method as the base unit which can be the hose unit of FIG. 1.

Figure 6:
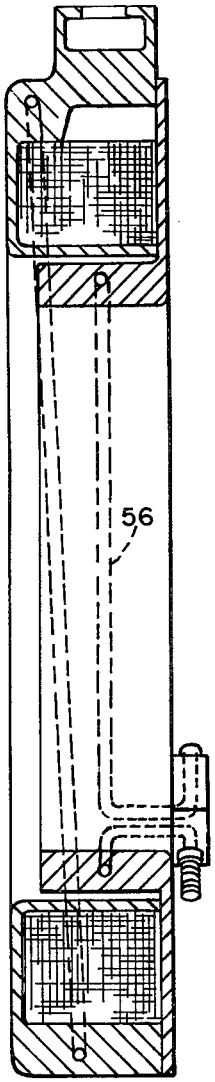
FIG. 6 is a side view of a current transformer as viewed from section lines VI—VI.

FIG. 6 shows a side view of the transformer case as seen from section line VI—VI which shows the top manifold 54 and cooling duct 56 embedded in the cover of the transformer case.

Figure 7:
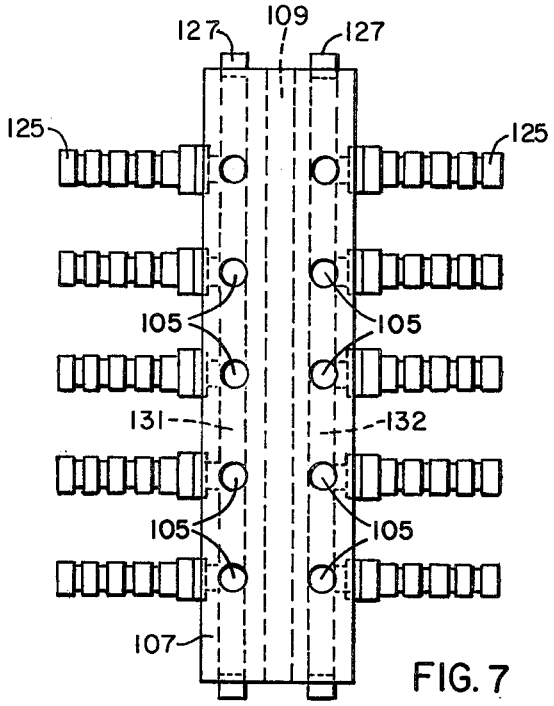
FIG. 7 is a manifold assembly with multiple cooling ducts.

For the situation where there is a large transformer case, another embodiment of this invention is shown in FIG. 7. In this case, there is a manifold 107 with a plurality of cooling ducts 105, connected in parallel to the nipples 125. Drilled through the length of the manifold is an input duct 132 and a return duct 131 which are plugged by end plugs 127. For holding the manifold in place there is an alignment hole 109 which runs the length of the block, and during the casting of the transformer case the hole 109 will be filled with the case material forming a retaining shaft.

Figure 8:
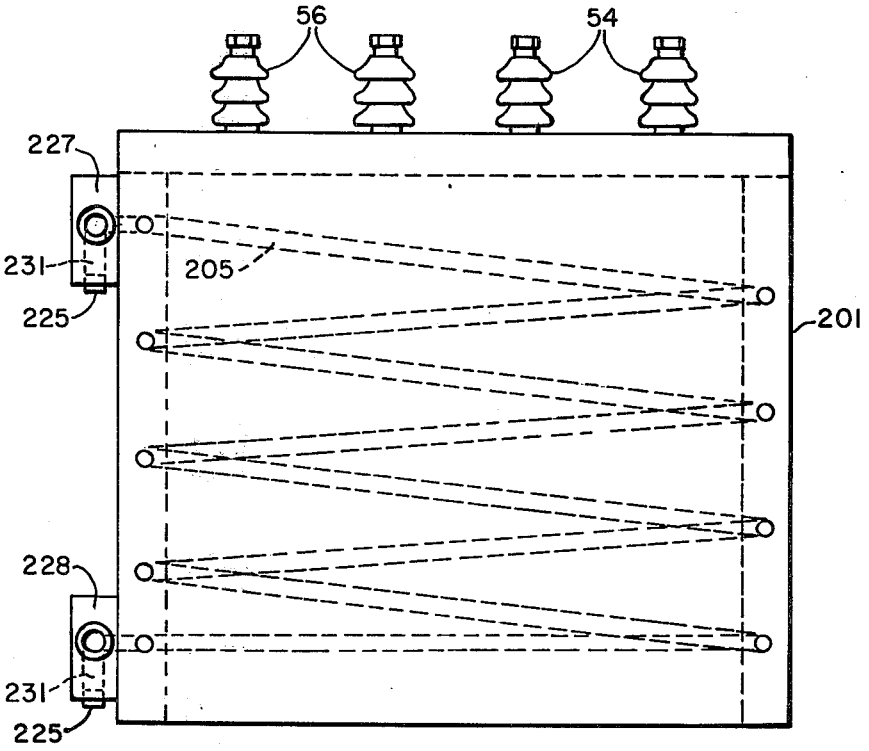
FIG. 8 is a side view of a transformer case using a coil arrangement of the cooling ducts.

FIG. 8 is a voltage transformer case. There is a case 201 which has a transformer mounted within (not shown) and the leads are brought out to primary terminals 54 and secondary terminals 56. Embedded within the transformer case itself is a manifold 227, a manifold 228 and cooling coil 205. The cooling duct in this case is shaped like a spiral coil and is connected between manifold 227 and manifold 228. Each manifold has a nipple 225 which connects to the cooling duct through conduit means 231.

We claim:

1. A transformer case comprising a top cover of aluminum which has a generally circular shape and a lip extending around its inner periphery;

a bottom case of aluminum which has a generally toroidal shape with an inner groove for holding a transformer winding; a cooling duct of stainless steel embedded within said aluminum case on its outer periphery; and a manifold means connecting said stainless steel duct to an input nipple and an output nipple to facilitate the connection to a liquid coolant source and a return means.

2. The transformer case according to claim 1 wherein said top cover has a manifold embedded within its top surface and is connected to a cooling duct embedded with said cover's lip.

* * * * *